US006899200B1

(12) United States Patent
Roberts et al.

(10) Patent No.: US 6,899,200 B1
(45) Date of Patent: May 31, 2005

(54) SOUND BARRIER

(75) Inventors: John Kenneth Roberts, 352 Annandale Street, Annandale, New South Wales 2038 (AU); Kenneth James Arcus, 43 Falcon Street, Crows Nest, New South Wales 2065 (AU)

(73) Assignees: John Kenneth Roberts, New South Wales (AU); Kenneth James Arcus, New South Wales (AU)

( * ) Notice: Subject to any disclaimer, the term of this patent is extended or adjusted under 35 U.S.C. 154(b) by 0 days.

(21) Appl. No.: 09/869,826

(22) PCT Filed: Jan. 7, 2000

(86) PCT No.: PCT/AU00/00006

§ 371 (c)(1),
(2), (4) Date: Dec. 12, 2001

(87) PCT Pub. No.: WO00/42255

PCT Pub. Date: Jul. 20, 2000

(30) Foreign Application Priority Data

Jan. 8, 1999 (AU) ..... PP 8094

(51) Int. Cl.[7] ..... E04B 2/74

(52) U.S. Cl. ..... 181/285; 181/284; 181/288; 181/294; 52/144

(58) Field of Search ..... 181/210, 284, 181/285–288, 290, 291, 293, 294; 52/144, 145

(56) References Cited

U.S. PATENT DOCUMENTS

| | | | | |
|---|---|---|---|---|
| 2,423,199 A | | 7/1947 | Milnor | |
| 4,143,495 A | | 3/1979 | Hintz | |
| 4,160,491 A | * | 7/1979 | Matsumoto et al. | 181/284 |
| 4,286,576 A | * | 9/1981 | McClelland | 126/617 |
| 4,674,593 A | | 6/1987 | McCarty | |
| 4,838,524 A | | 6/1989 | McKeown et al. | |
| 5,247,773 A | | 9/1993 | Weir | |
| 5,406,039 A | | 4/1995 | Rerup et al. | |
| 6,123,171 A | * | 9/2000 | McNett et al. | 181/290 |

FOREIGN PATENT DOCUMENTS

| | | | | |
|---|---|---|---|---|
| AU | 50547/96 A | | 10/1996 | |
| CZ | 9401673 A3 | | 2/1996 | |
| DE | 3012514 A | | 10/1981 | |
| DE | 3043132 A | | 6/1982 | |
| DE | 3426639 A | | 3/1986 | |
| DE | 42 31 541 A | | 3/1994 | |
| EP | 25632 A | | 3/1981 | |
| GB | 2235942 A | | 3/1991 | |
| JP | 05148923 A | * | 6/1993 | E04B/1/82 |
| JP | 10-292326 A | | 11/1998 | |
| WO | WO 95 21979 A | | 8/1995 | |
| WO | 97/24492 A | | 7/1997 | |

* cited by examiner

*Primary Examiner*—Marlon T. Fletcher
*Assistant Examiner*—David Warren
(74) *Attorney, Agent, or Firm*—Henricks, Slavin & Holmes LLP

(57) ABSTRACT

The present invention provides a sound barrier 1 including a plurality of elongate panels 2 having first and second ends 3 and 4, each panel 2 being formed from a shell 5 defining an inner chamber 6 adapted to contain sound attenuating liquid, said plurality of panels 2 being supportable in a planar configuration by a first support means 7 adapted to engage said first and second ends 3 and 4 respectively.

Preferably the shell 5 is constructed from plastic and/or fiberglass and the sound attenuating liquid is water which may optionally include other materials such as sand, slurry, concrete rubble, mud, etc.

Some embodiments include second support means 9 which are attachable to the post 7 so as to engage the panels 2 and thereby transfer a, substantial portion, or all of, the weight of each panel 2 to the post 7.

12 Claims, 8 Drawing Sheets

3
27
27
4
7
1
3
27
7
16
2
16
9
2
9
2
9
2
9
2

SOUND BARRIER

TECHNICAL FIELD

The present invention relates to a sound barrier. The invention has been developed primarily for installation adjacent highways and will be described hereinafter with reference to this application. However, it will be appreciated that the invention is not limited to this particular field of use. In particular, the invention is also suited to applications such as fencing and signage which may be used to attenuate the noise associated with structures such as buildings, factories, offices, railways, airports, building construction sites and the like.

BACKGROUND ART

Prior art sound barriers provided adjacent highways are typically large concrete slabs which are mounted with cranes. Such sound barriers are comparatively expensive to manufacture. Additionally, due to their bulky shape and heavy weight, they are difficult and expensive to transport and erect.

DISCLOSURE OF THE INVENTION

It is an object of the present invention to overcome or ameliorate at least one of the disadvantages of the prior art, or to provide a useful alternative.

According to one aspect of the invention there is provided a sound barrier including a plurality of elongate panels having first and second ends, each panel being formed from a shell defining an inner chamber adapted to contain sound attenuating liquid, said plurality of panels being supportable in a planar configuration by one or more first support means adapted to engage said first and/or second ends.

Preferably the shell is constructed from plastic and/or fiberglass and the sound attenuating liquid is water which may optionally include other materials such as sand, slurry, concrete rubble, mud, etc.

Some embodiments include second support means which are attachable to the post 7 so as to engage the panels and thereby transfer a substantial portion, or all of, the weight of each panel to the post.

According to a second aspect of the invention there is provided a method of erecting a sound barrier including the steps of:

a) providing a plurality of elongate panels each including a hollow shell adapted to contain sound attenuating liquid and each having first and second ends;

b) erecting a plurality of generally vertical posts each having post channels; and c) engaging said first and second ends with said post channels such that said panels are mounted between said posts in a planar configuration.

According to a third aspect of the invention there is provided a method of constructing a sound barrier including the steps of:

a) extruding or moulding a hollow shell from a plastics or fiberglass material to form a longitudinal panel having first and second open ends; and b) providing first and second end faces so as to seal said first and second open ends respectively such that said shell is adapted to contain sound attenuating liquid.

According to another aspect of the invention there is provided a method of constructing a sound barrier including the steps of:

a) moulding two separate complementary pieces of a shell, each piece including a peripheral flange;

b) joining the respective peripheral flanges of said complementary pieces so as to define a hollow shell adapted to contain sound attenuating liquid.

Preferably, each said piece includes a generally planar side wall with transversely extending walls at or near a periphery of the planar side wall, said peripheral flange being disposed upon said transversely extending walls.

A preferred embodiment of this aspect of the invention includes a further step of applying a reinforcing member to an interior side of said planar side wall such that, when said shell is formed, the reinforcing member resists transverse bulging due to pressure exerted by said sound attenuating liquid.

BRIEF DESCRIPTION OF THE DRAWINGS

Preferred embodiments of the invention will now be described, by way of example only, with reference to the accompanying drawings in which.

MODES FOR CARRYING OUT THE INVENTION

Figure 1:
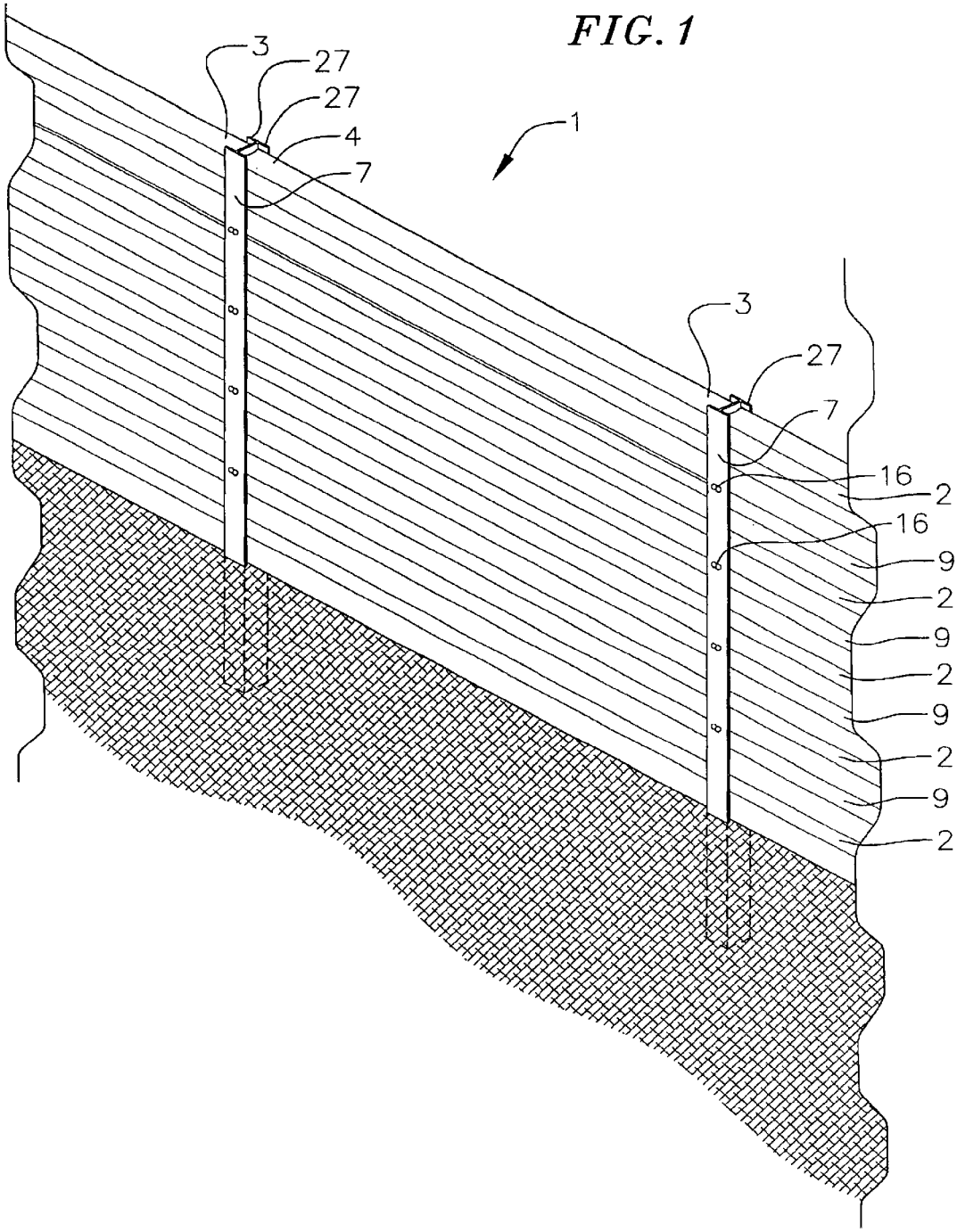
FIG. 1 is a perspective view of a first embodiment of a sound barrier according to the invention.
Figure 2:
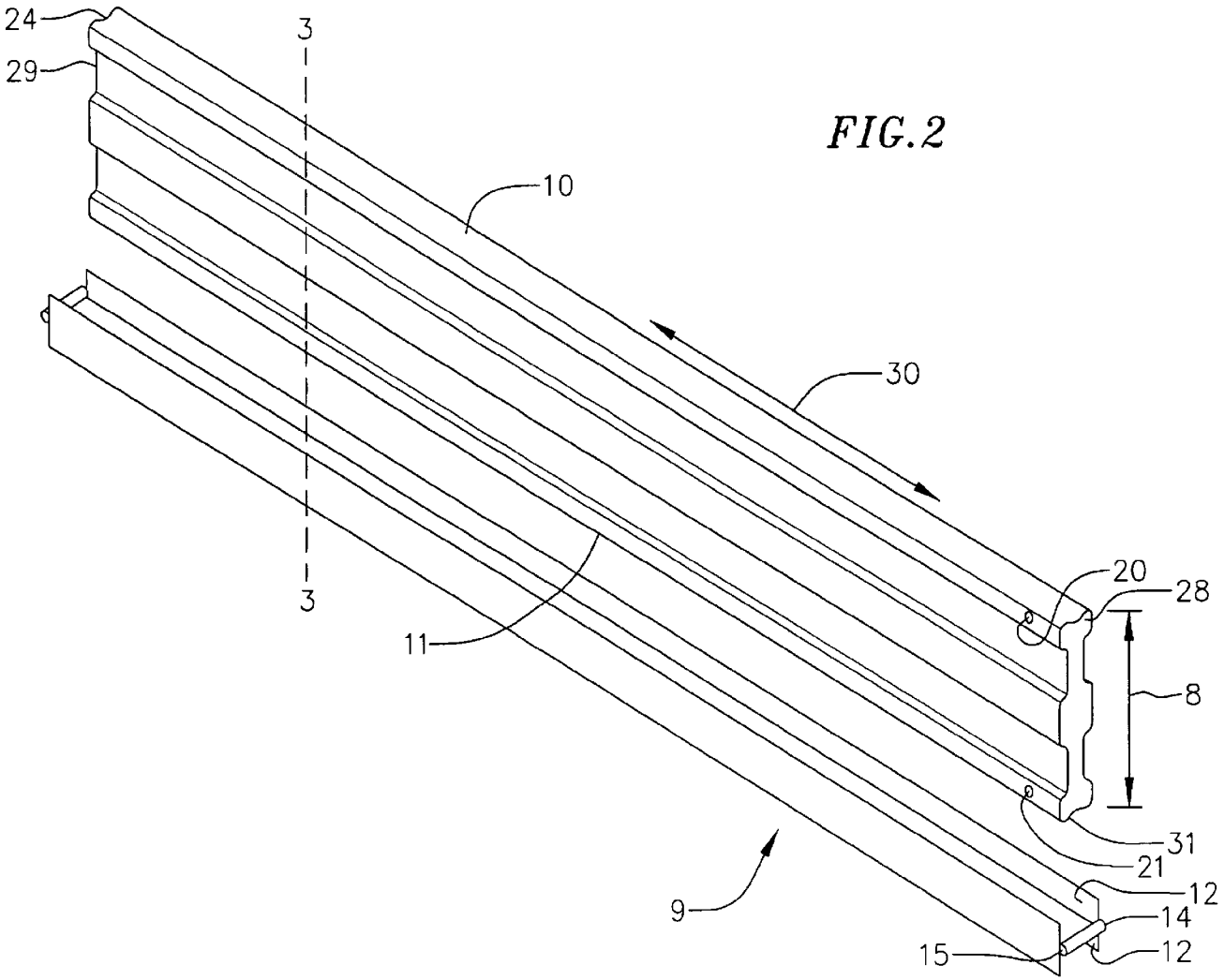
FIG. 2 is a perspective view of a panel and a beam according to the first embodiment.

Referring to the drawings, the sound barrier 1 includes a plurality of elongate panels 2 having first and second ends 3 and 4. Each panel 2 is formed from a shell 5 defining an inner chamber 6 adapted to contain sound attenuating liquid (not shown) such as water which may optionally contain other materials such as sand, slurry, concrete rubble, mud, etc. As shown in FIG. 1, the plurality of panels 2 are supported in a planar configuration by a first support means 7 in the form of vertical posts which engage the first and second ends 3 and 4 of each panel 2.

In one embodiment the shell 5 is constructed from a plastics material which preferably does not degrade when subject to weathering elements such as sunlight or rain and is of sufficient strength to resist the pressure exerted by the sound attenuating liquid without significantly buckling or bulging. To improve the aesthetic qualities of the sound barrier, the plastics material may include colouring agents.

In another embodiment the shell is constructed from fiberglass. If required, a coloured gel may be embedded within at least one layer of the fiberglass to provide signage or patterns including different colours on either side. The embedding of the coloured gel within the fiberglass allows the surface to be buffed so as to restore the original shine and colours to a panel which may have otherwise faded due to exposure to the elements. This arrangement is also graffiti resistant in that most spray painted graffiti will wash off the surface of the fiberglass when cleaned with a high pressure water cleaner, leaving the embedded coloured gel intact.

In various embodiments the panels 2 have heights 8 ranging between 200 mm and 1000 mm. A more preferable range of heights 8 is between 250 mm and 700 mm, or still more preferably, between 300 mm and 650 mm. By thus restricting the height of each panel, the pressure exerted by the sound attenuating liquid at the lower-most edge of each panel is correspondingly reduced. In particular, many of the prior art sound barriers are often as high as 4.2 m. A single panel according to the present invention having a height of 4.2 m would undesirably result in a very large pressure being exerted upon the lower-most surface 31 of the panel shell.

The longitudinal axis 30 of each panel 2 is substantially horizontally disposed when said panels are mounted to the posts 7. This arrangement is shown in FIG. 1 and once again helps to minimise the pressure exerted by the sound attenuating liquid upon the lower-most surface 31 of each panel shell 5.

Figure 9:
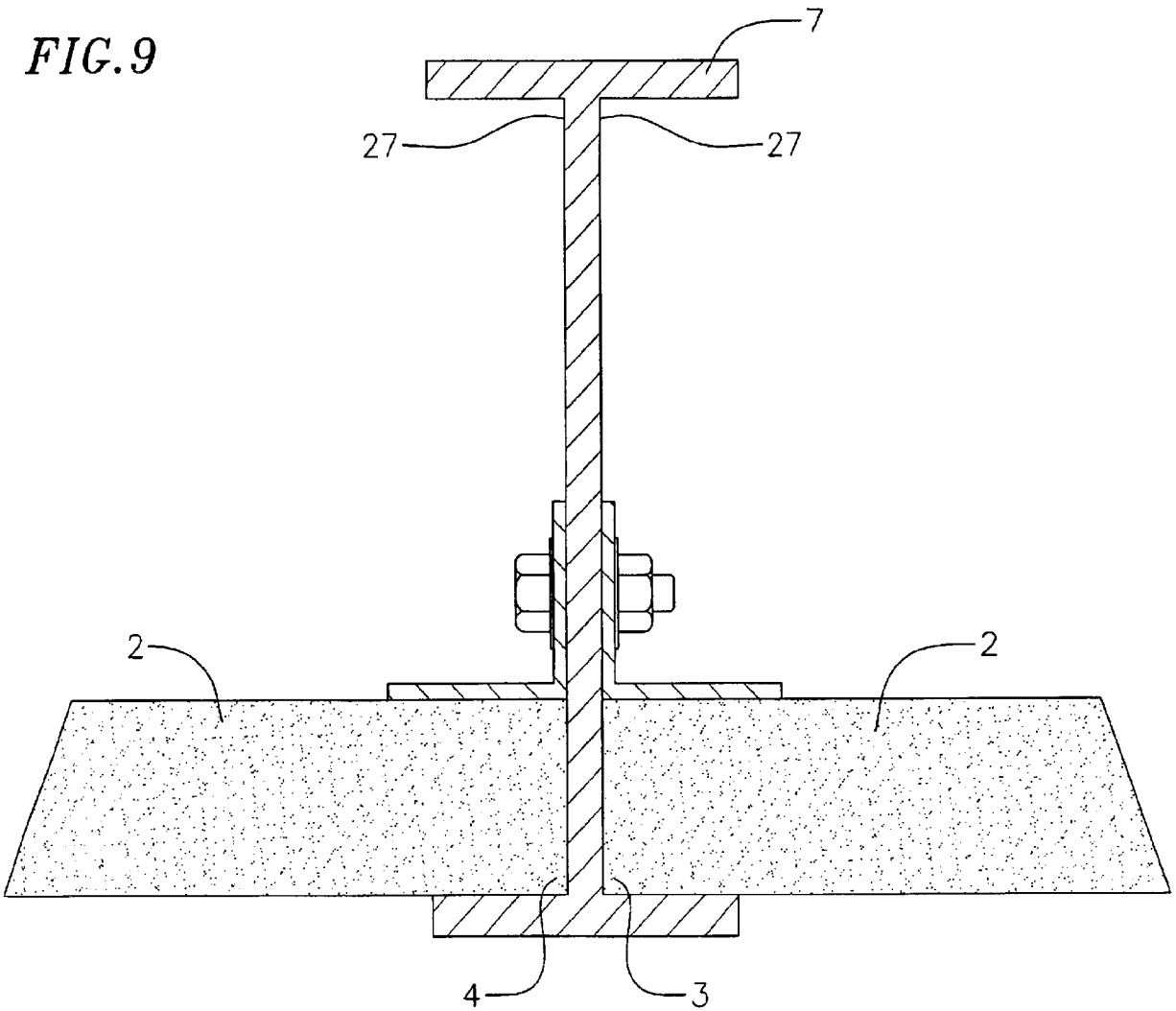
FIG. 9 is a cross sectional view of a pair of panels mounted to a post.

The posts 7 include post channels 27 adapted to engage the first ends 3 of each panel 2. Indeed, each post 7 is adapted to engage both a first end 3 of a panel 2 disposed on a first side of the post and a second end 4 of another panel 2 disposed on an opposing side of the post. This is illustrated in FIG. 9.

Second support means 9, in the form of beams, are attachable to the post 7 so as to engage the panels 2 and thereby transfer a substantial portion, or all of, the weight of each panel 2 to the post 7. In this manner, the force due to the weight of an upper panel is not transferred directly to the adjacent lower panel. Hence, the pressure within the lower panels is advantageously reduced.

Figure 3:
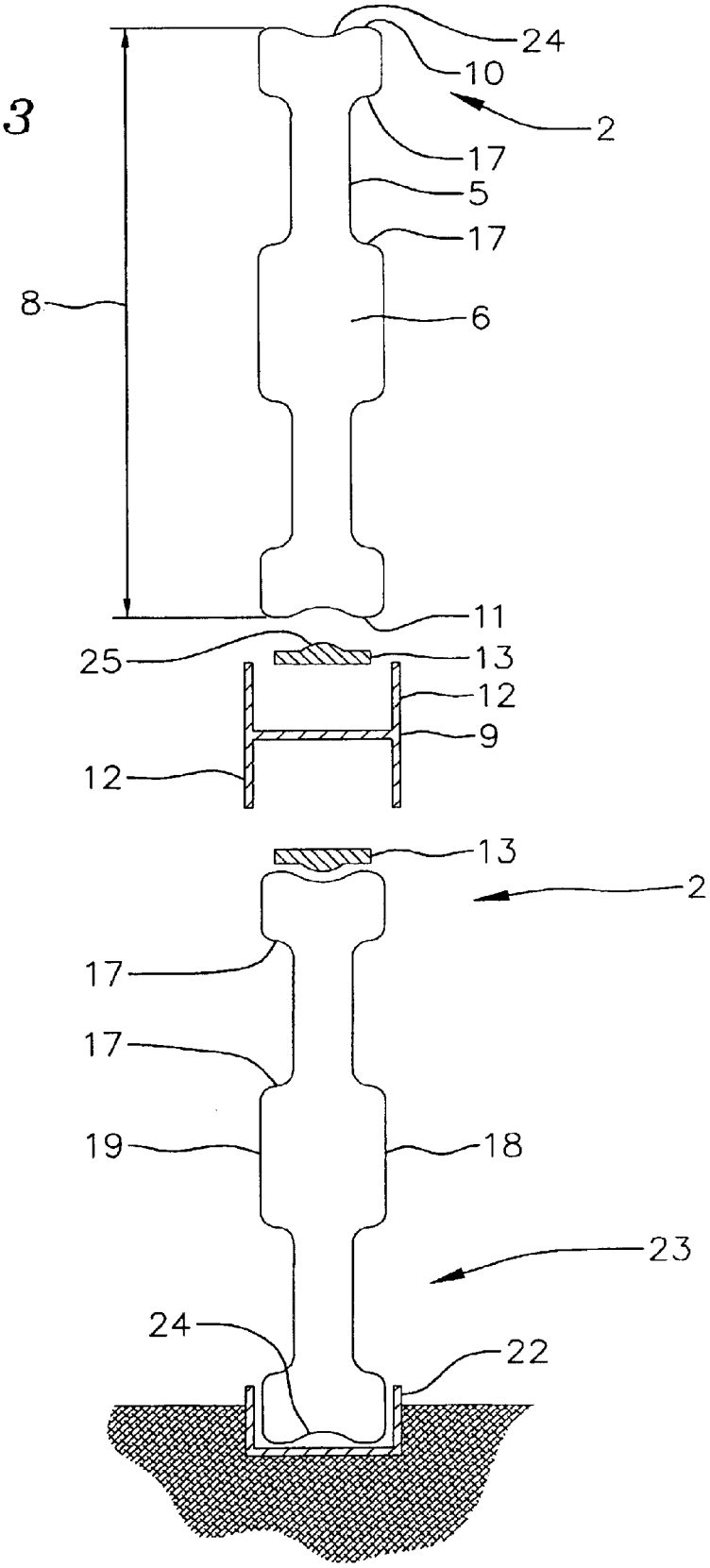
FIG. 3 is a cross-sectional exploded view showing two panels and a beam as seen from line 3—3 of FIG. 2 and also showing two grommets and a ground channel, all according to the first embodiment.
Figure 4:
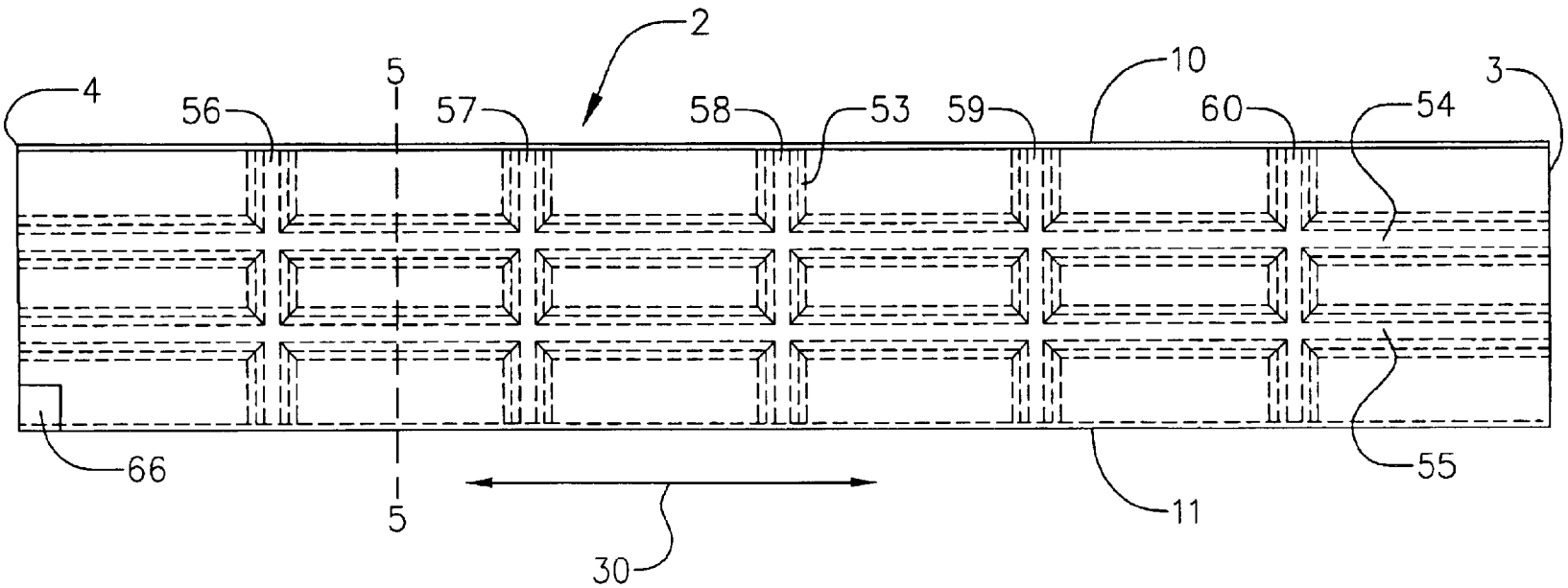
FIG. 4 is a side elevation of a second embodiment of a panel according to the invention.

Each of the panels 2 includes upper and lower edges 10 and 11 extending substantially parallel with the longitudinal axis 30. The beams 9 are attached between the posts 7 so as to engage an upper or lower edge 10 or 11 of the panels 2. More particularly, the beams 9 include cylindrical members 14 with transverse apertures 15 adapted to receive fastening means (not shown) so as to fixedly attach the beam 9 to the post 2. In the preferred embodiment the fastening means are in the form of bolts. As shown in FIG. 1, the post 7 include pre-drilled holes 16 which are each adapted to mate with each bolt respectively. This arrangement provides further support to maintain the panels 2 in a planar configuration and also allows for the weight transferral of each panel 2 to the posts 7 as mentioned above. Each of the beams 9 include beam channels 12 adapted to engage the upper or lower edges 10 or 11 of the panels 2. As best shown in FIG. 3, grommets 13 are disposed intermediate the beams 9 and the panels 2. In the preferred embodiment the grommets are constructed from a rubber material.

The panels 2 include formations 17 adapted to resist bulging of the shell 5 due to pressure exerted by the sound attenuating liquid. The formations 17 are in the form of longitudinally extending panel channels provided in first and second opposing sides 18 and 19 of the panel 2.

Each panel 2 includes a filler plug 20 disposed adjacent the upper edge 10 to facilitate filling of the shell 5 with the sound attenuating liquid. Further, each panel 2 includes a drain plug 21 disposed adjacent the lower edge 11 to facilitate draining of said attenuating liquid from the shell 5.

As shown in FIG. 3, a ground channel 22 adapted to engage the lower edge 11 of a lower-most panel 23 is recessed into the ground to provide further support for the sound barrier structure and to improve the aesthetic appeal of the sound barrier.

The upper and lower edges 10 and 11 each include a longitudinally extending edge channel 24 adapted to mate with a corresponding formation 25 provided upon the grommet 13. The edge channel 24 is in the form of a concave recess and the formation 25 upon the grommet is in the form of a convex projection.

FIGS. 4 to 8 illustrate a second embodiment of the barrier. Some of the features shared by the first and second embodiments are marked onto these figures using the same reference numerals as were used above.

Figure 7:
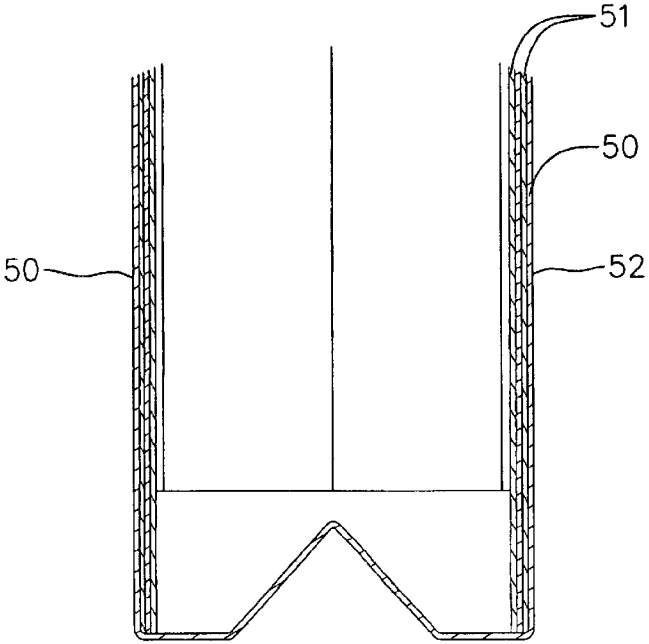
FIG. 7 is a detail view of the region marked 'A' in FIG. 5.

The second embodiment dispenses with the longitudinally extending panel channels 17 of the first embodiment. Rather, the side walls 50 are substantially planar. As best shown in FIG. 7, the side walls 50 are constructed from a plurality of plies 51 of material such as fiberglass. The number of plies is preferably between 3 and 5, and the illustrated preferred embodiment has four plies. The extra plies provide added strength to assist the side walls to resist transverse bulging due to pressure exerted by the sound attenuating liquid. Coloured gel may be embedded in the outermost ply 52 to provide patterns, signage and other visual effects.

In another embodiment (not illustrated) the strength of the side wall 50 is at a minimum toward the top edge 10 (for example by having a thickness of 1 or 2 plies) and is at a maximum toward the bottom edge 11 (for example by having a thickness of 3 or 4 plies). This strength distribution roughly matches the pressure exerted by sound attenuating liquid such as water, which is greatest toward the bottom edge 11.

Figure 5:
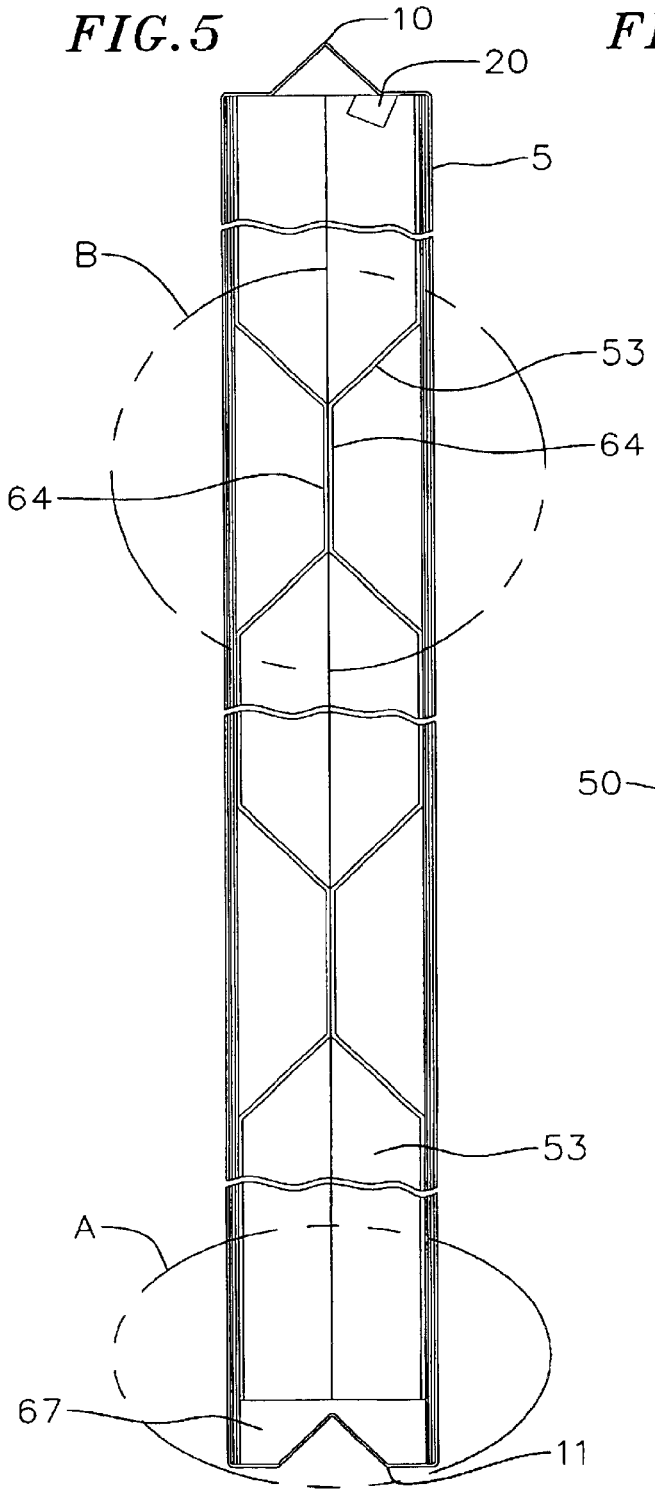
FIG. 5 is a cross-sectional view of the panel shown in FIG. 4 taken through line 5—5.
Figure 6:
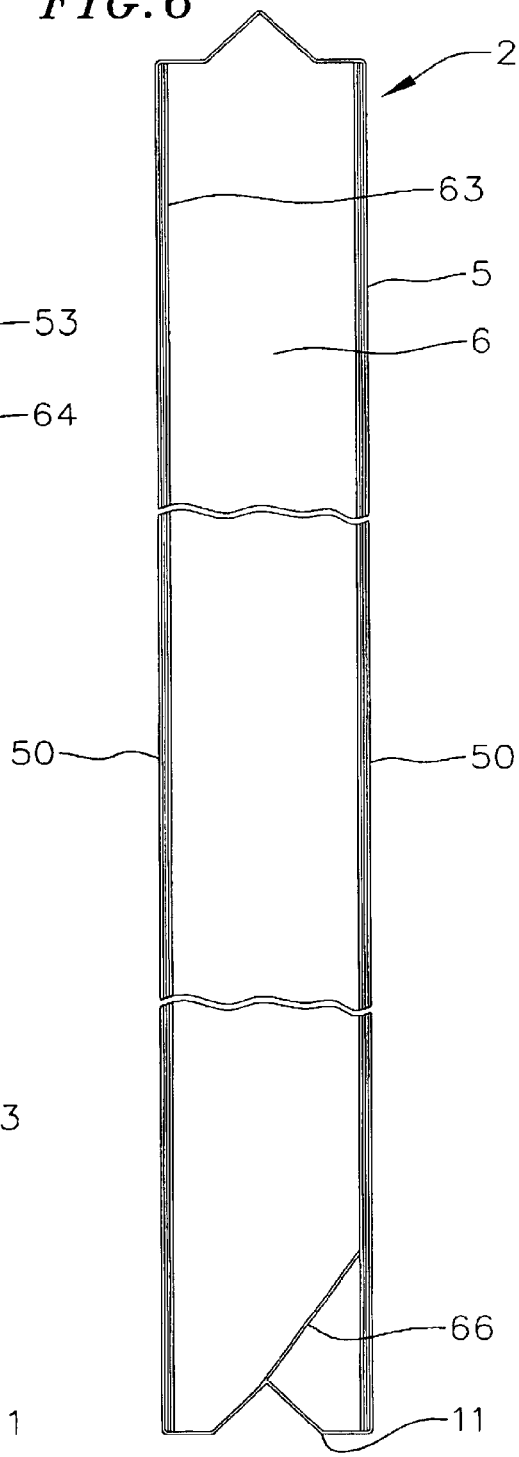
FIG. 6 is a cross-sectional view of the panel shown in FIG. 4 taken through line 6—6, except shown without internal bracing.
Figure 8:
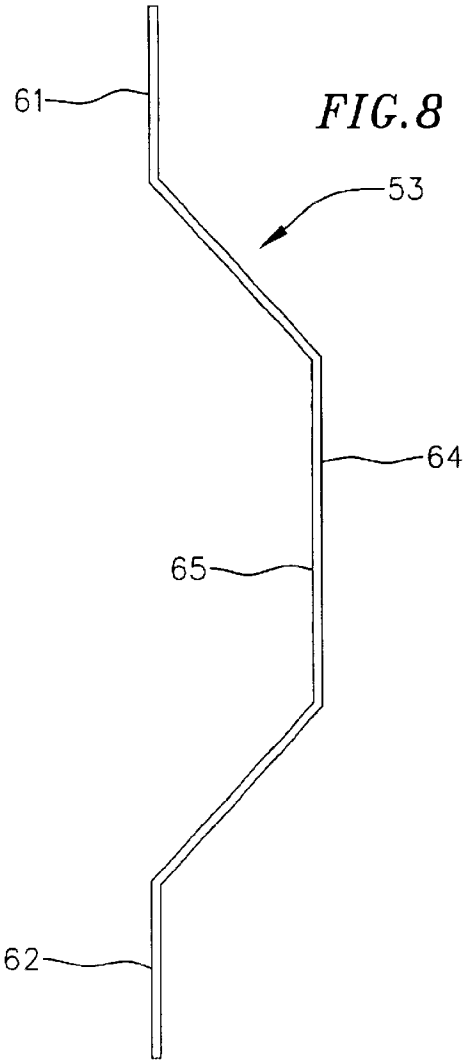
FIG. 8 is a detail view of a brace in the region marked 'B' in FIG. 5.

Protection against bulging may also be provided by reinforcing members 53, as best shown in FIGS. 5 and 8. One or more reinforcing members 53 are disposable within the shell 5 intermediate and attached to opposing side walls 50. In the embodiment illustrated in FIG. 4, the reinforcing member 53 joins the side walls 50 along two horizontal lines 54 and 55, and along five vertical lines 56, 57, 58, 59 and 60.

The reinforcing members 53 may take the form of braces, a side view of which is provided by FIG. 8. First and second surfaces 61 and 62 are glued by resin to an inner side 63 of the side wall 50. This allows third surface 64 to project to an approximate lateral mid point of the shell 5 to abut a like third surface 64 of a like brace 53 attached to the opposing side wall 50. The two abutting third surfaces 64 are adhesively attachable to each other, for example by gluing with resin, and thereby resist transverse bulging of the side walls.

In one embodiment (not illustrated) the third surfaces 64 include one or more apertures which enable glue, for example resin, to travel through the apertures as the two third surfaces 64 are forced into abutment with resin in between. Some of the resin can then protrude from the opposite side 65 of the brace 53. Once dried, the protruding resin effectively acts like a rivet, further strengthening the adhesion of the two abutting third surfaces 64.

Other preferred reinforcing members (not illustrated) are in the form of a single member which spans the gap between opposing side walls 50 and is attachable thereto, for example by gluing.

Gaps 67 between the reinforcing members 53 and the edges of the shell 5 allow sound attenuating fluid such as water to fill the whole interior of the shell, rather than being trapped by a single segment bounded by the reinforcing member.

An angled recess 66 is provided adjacent the lowermost edge 11 to provide access to drain plug 21.

The preferred embodiments of the present invention advantageously provide far cheaper alterative sound barriers as compared to the concrete slabs of the prior art. Additionally, the hollow panels may be transported in an empty state, thereby weighing significantly less than the concrete required for a prior art sound barrier. The light weight empty panels 2 can be erected far more easily than concrete barriers, without the necessity of a crane to manhandle the heavy concrete slabs.

The preferred method of erecting the sound barrier includes the steps of:

a) providing a plurality of panels 2 each including a hollow shell 5 adapted to contain sound attenuating liquid and each having first and second ends 3 and 4;

b) erecting a plurality of generally vertical posts 7 each having post channels 27;

c) engaging said first and second ends 3 and 4 with said post channels 27 such that said panels 2 are mounted between said posts 7 in a planar configuration.

This method preferably includes a further step of recessing a ground channel 22 into the ground so as to support a lower edge 11 of a lower-most panel 23.

One of the preferred methods of constructing the sound barrier includes the following steps:

a) extruding or moulding a hollow shell 5 from a plastics material to form a longitudinal panel 2 having first and second open ends 3 and 4;

b) providing first and second end faces 28 and 29 so as to seal said first and second open ends 3 and 4 respectively such that the shell 5 is adapted to contain sound attenuating liquid.

Figure 10:
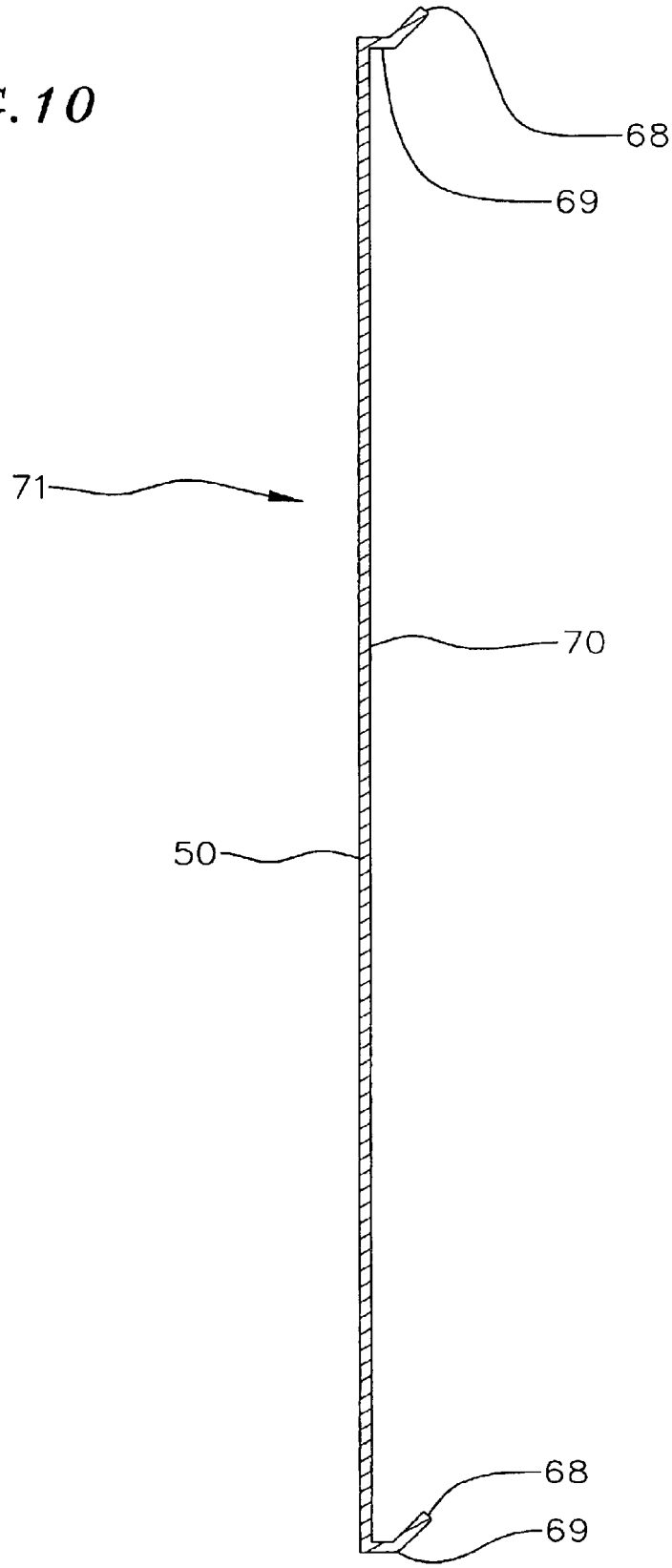
FIG. 10 is a cross sectional view of a piece of shell prior to assembly.

The shell 5 is then filled with sound attenuating liquid, for example water, which may optionally include other materials, such as sand, slurry, concrete rubble, mud, etc. Another of the preferred methods of constructing the sound barrier 1 includes the following steps:

a) moulding two separate complementary pieces 71 of a shell 5, each piece 71 including a peripheral flange 68, as shown in FIG. 10;

b) joining the respective peripheral flanges 68 of said complementary pieces 71 so as to define a hollow shell 5 adapted to contain sound attenuating liquid, for example water.

In some embodiments, each piece 71 includes a generally planar side wall 50 with transversely extending walls 69 at or near the periphery of the planar side wall 50. The peripheral flange 68 is disposed upon the transversely extending walls 69. Preferably the peripheral flanges of two pieces 71 are joined by gluing, for example with resin.

A preferred step in this method involves applying a reinforcing member 53 to an interior side 70 of said planar side wall 50 such that, when said shell 5 is formed, the reinforcing member 53 resists transverse bulging due to pressure exerted by said sound attenuating liquid. If reinforcing members such as that shown in FIG. 8 are used, the third surfaces 64 may be joined by resin at the same time as the peripheral flanges 68 of two pieces 71 are glued.

Although the invention has been described with reference to specific examples, it will be appreciated that those skilled in the art that the invention may be embodied in many other forms.

What is claimed is:

1. A sound barrier including a plurality of elongate panels having first and second ends, each panel being formed from a shell defining an inner chamber adapted to contain sound attenuating liquid, each panel including one or more longitudinally extending panel channels provided in first and second opposing sides of each of said panels so as to resist bulging of said shell due to pressure exerted by said sound attenuating liquid, said plurality of panels being supportable in a planar configuration by at least one first support means adapted to engage respective ones of said first and second ends.

2. A sound barrier according to claim 1 wherein each panel includes a filler plug disposed adjacent an upper edge of the panel to facilitate filling of said shell with said sound attenuating liquid.

3. A sound barrier according claim 1 wherein each panel includes a drain plug disposed adjacent a lower edge of the panel to facilitate draining of said attenuating liquid from said shell.

4. A sound barrier including:

a plurality of elongate panels having first and second ends, wherein at least one of said panels includes substantially planar side walls constructed from a plurality of plies of fiberglass;

each panel being formed from a shell defining an inner chamber adapted to contain sound attenuating liquid;

said plurality of Panels being supportable in a planar configuration by one or more first support means adapted to engage said first and/or second ends; and wherein said side walls are constructed from between three and five plies of fiberglass.

5. A sound barrier including:

a plurality of elongate panels having first and second ends, wherein at least one of said panels includes substantially planar side walls constructed from a plurality of plies of fiberglass;

each panel being formed from a shell defining an inner chamber adapted to contain sound attenuating liquid;

said plurality of panels being supportable in a planar configuration by one or more first support means adapted to engage said first and/or second ends; and wherein the plurality of plies includes an outer ply of fiberglass embedded with at least one colored gel.

6. A sound barrier including a plurality of elongate panels having first and second ends, each panel being formed from a shell defining an inner chamber adapted to contain sound attenuating liquid, said shell further defining an opposed pair of sidewalls each having a minimum strength towards a top edge and a maximum strength towards a bottom edge, said plurality of panels being supportable in a planar configuration by at least one first support means adapted to engage said a respective one of the first and second ends.

7. A sound barrier according to claim 6 wherein at least one of said side walls has a minimum thickness towards its top edge and a maximum thickness towards its bottom edge.

8. A sound barrier including a plurality of elongate panels having first and second ends, each panel being formed from a shell defining an inner chamber adapted to contain sound attenuating liquid, said plurality of panels being supportable in a planar configuration by at least one first support means adapted to engage said a respective one of the first and second ends, said sound barrier further including a reinforcing member disposed within said shell so as to resist bulging of said shell due to pressure exerted by said sound attenuating liquid.

9. A sound barrier according to claim 8 wherein said reinforcing member is attached to opposing side walls of the shell.

10. A sound barrier according to claim 8 wherein said reinforcing member includes first and second surfaces attachable to said side wall, and a third surface which, when said reinforcing member is installed, is disposed so as to abut a like third surface of a like reinforcing member attached to an opposing side wall.

11. A sound barrier according to claim 10 wherein said third surfaces are adhesively attachable to each other.

12. A sound barrier according to claim 10 wherein said third surface includes at least one aperture.

* * * * *